US008235378B2

(12) United States Patent
Mitsuya et al.

(10) Patent No.: US 8,235,378 B2
(45) Date of Patent: Aug. 7, 2012

(54) SHEET TAKE-OUT APPARATUS

(75) Inventors: Yusuke Mitsuya, Kanagawa-ken (JP); Yoshihiko Naruoka, Kanagawa-ken (JP); Yukio Asari, Kanagawa-ken (JP); Naruaki Hiramitsu, Kanagawa-ken (JP); Tetsuo Watanabe, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 238 days.

(21) Appl. No.: 12/200,172

(22) Filed: Aug. 28, 2008

(65) Prior Publication Data

US 2009/0057982 A1 Mar. 5, 2009

(30) Foreign Application Priority Data

Aug. 29, 2007 (JP) ..... 2007-222640

(51) Int. Cl.
*B65H 3/12* (2006.01)

(52) U.S. Cl. ..... 271/96; 271/93; 271/104; 271/90; 271/112; 271/108

(58) Field of Classification Search ..... 271/112, 271/93, 96, 104, 90, 108
See application file for complete search history.

(56) References Cited

U.S. PATENT DOCUMENTS

| | | | | |
|---|---|---|---|---|
| 3,599,967 | A * | 8/1971 | Rapparlie et al. | 271/12 |
| 4,018,434 | A * | 4/1977 | Mitchell et al. | 271/96 |
| 5,074,539 | A * | 12/1991 | Wells et al. | 271/12 |
| 5,112,040 | A * | 5/1992 | Johnston et al. | 271/11 |
| 5,391,051 | A * | 2/1995 | Sabatier et al. | 414/797.2 |
| 5,704,607 | A * | 1/1998 | Brotherston | 271/96 |
| 6,186,491 | B1 * | 2/2001 | Tomiyama et al. | 271/12 |
| 6,254,081 | B1 * | 7/2001 | Rasmussen et al. | 271/96 |
| 6,279,896 | B1 * | 8/2001 | Linder et al. | 271/98 |
| 6,702,275 | B2 * | 3/2004 | Niiyama et al. | 271/98 |

(Continued)

FOREIGN PATENT DOCUMENTS

EP 0 645 330 B1 3/1995

(Continued)

OTHER PUBLICATIONS

Korean Office Action dated Dec. 14, 2010.

(Continued)

*Primary Examiner* — Michael McCullough
*Assistant Examiner* — Howard Sanders
(74) *Attorney, Agent, or Firm* — Pillsbury Winthrop Shaw Pittman LLP

(57) ABSTRACT

A sheet take-out apparatus includes a supplying structure configured to move a plurality of sheets supplied in a stacking state in a stacking direction and supply a sheet at a leading edge thereof in a movement direction to a take-out position, a take-out structure configured to make contact with the sheet supplied to the take-out position and rotate, thereby taking out the sheet in a direction almost orthogonal to the stacking direction, and move the sheet to a conveying route, a suction structure configured to generate an air current to suck the sheet at the leading edge in the movement direction to the take-out position on an upstream side of a position where the take-out structure makes contact with the sheet in the sheet take-out direction by the take-out structure, and a controller configured to control an operation of the suction structure so as to decrease suction force by the suction structure when the sheet at the leading edge in the movement direction is not taken out by the take-out structure.

4 Claims, 13 Drawing Sheets

U.S. PATENT DOCUMENTS

| | | | | |
|---|---|---|---|---|
| 7,172,116 | B2 * | 2/2007 | Yamamiya | 235/381 |
| 7,198,264 | B2 * | 4/2007 | Kashiba et al. | 271/11 |
| 7,396,010 | B2 * | 7/2008 | Naruoka et al. | 271/149 |
| 7,628,393 | B2 * | 12/2009 | Mitsuya et al. | 271/10.01 |
| 2002/0011703 | A1 * | 1/2002 | Tomiyama et al. | 271/12 |
| 2003/0178763 | A1 * | 9/2003 | Hiramitsu et al. | 271/152 |
| 2006/0017216 | A1 * | 1/2006 | Mitsuya et al. | 271/121 |
| 2007/0222137 | A1 * | 9/2007 | Mitsuya et al. | 271/10.01 |
| 2007/0262512 | A1 * | 11/2007 | Watanabe et al. | 271/11 |
| 2008/0296829 | A1 * | 12/2008 | Asari et al. | 271/95 |
| 2009/0309292 | A1 * | 12/2009 | Mitsuya et al. | 271/11 |
| 2010/0001456 | A1 * | 1/2010 | Mitsuya et al. | 271/112 |
| 2010/0032889 | A1 * | 2/2010 | Krause et al. | 271/12 |

FOREIGN PATENT DOCUMENTS

| | | | |
|---|---|---|---|
| JP | 51-103280 | U | 8/1976 |
| JP | 58-16728 | U | 2/1983 |
| JP | 59-33848 | U | 3/1984 |
| JP | 60-190767 | U | 12/1985 |
| JP | 07-149442 | A | 6/1995 |
| JP | 10-310272 | | 11/1998 |
| JP | 11-11712 | | 1/1999 |
| JP | 2001-88957 | | 4/2001 |
| JP | 2003-341860 | A | 12/2003 |
| KR | 1019860000008 | B1 | 10/1983 |
| KR | 1020030080223 | | 10/2003 |
| KR | 1020060048030 | | 5/2006 |
| KR | 1020070096846 | | 10/2007 |

OTHER PUBLICATIONS

Korean Notice of Allowance dated Mar. 16, 2011.

* cited by examiner

SHEET TAKE-OUT APPARATUS

CROSS-REFERENCE TO RELATED APPLICATION

This application is based upon and claims the benefit of priority from the prior Japanese Patent Application No. 2007-222640, filed on Aug. 29, 2007; the entire contents of all of which are incorporated herein by reference.

FIELD OF THE INVENTION

The present invention relates to a sheet take-out apparatus for taking out stacked sheets one by one onto a conveying route and for example, to a sheet take-out apparatus and a sheet take-out method for taking out postal matter one by one.

DESCRIPTION OF THE BACKGROUND

Conventionally, for example, as disclosed in Japanese Patent Application Publication No. 2003-341860, as an apparatus for taking out a plurality of stacked sheets one by one, an apparatus for permitting a take-out roller to make contact with a sheet at one end in the stacking direction and rotate, thereby taking out the sheet in the direction almost orthogonal to the stacking direction is known. This apparatus, for example, is incorporated into a postal matter processing apparatus for checking and sorting a plurality of postal matter.

Further, for example, as disclosed in EPO 645330B1, as such a take-out apparatus, an apparatus including a belt moving in the take-out direction in contact with sheets and a negative pressure generator for permitting the moving belt to absorb the sheets by acting negative pressure on the sheets via a plurality of holes of the belt is known. This apparatus has a suction structure having no conveying force outside the belt and generates an air current for sucking sheets to the belt.

However, in the apparatus disclosed in EPO 645330B1, sheets are stuck to the opening of the suction structure, thus there are possibilities that the sheets may not be taken out. In this case, the processing capacity of the apparatus is reduced and sheets cannot be taken out stably.

SUMMARY OF THE INVENTION

An object of the present invention is to provide a sheet take-out apparatus and a sheet taking-out method capable of taking out sheets stably without reducing the processing capacity.

To accomplish the above object, there is provided a sheet take-out apparatus comprising a supplying structure configured to move a plurality of sheets supplied in a stacking state in a stacking direction and supply a sheet at a leading edge thereof in a movement direction to a take-out position; a take-out structure configured to make contact with the sheet supplied to the take-out position and rotate, thereby taking out the sheet in a direction almost orthogonal to the stacking direction, and move the sheet to a conveying route; a suction structure configured to generate an air current to suck the sheet at the leading edge in the movement direction to the take-out position on an upstream side of a position where the take-out structure makes contact with the sheet in the sheet take-out direction by the take-out structure; and a controller configured to control an operation of the suction structure so as to decrease suction force by the suction structure when the sheet at the leading edge in the movement direction is not taken out by the take-out structure.

Further, there is provided A sheet take-out method comprising moving a plurality of sheets supplied in a stacking state in a stacking direction and supplying a sheet at a leading edge in a movement direction to a take-out position; moving the sheet supplied to the take-out position to a conveying route by taking out the sheet in a direction almost orthogonal to the stacking direction; generating an air current to suck the sheet at the leading edge in the movement direction to the take-out position on an upstream side of the take-out position; and decreasing suction force by the generated air current when the sheet at the leading edge in the movement direction is not taken out.

DETAILED DESCRIPTION OF THE INVENTION

Figure 1:
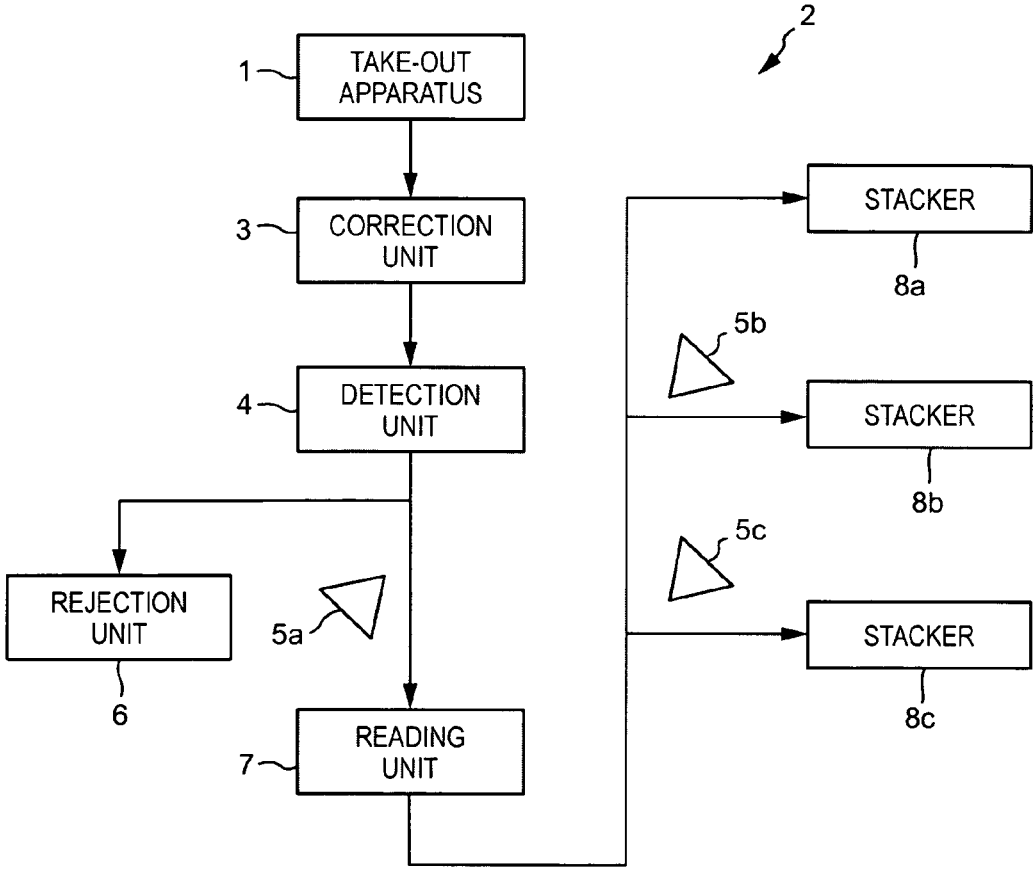
FIG. 1 is a block diagram showing the constitution of the postal matter processing apparatus relating to the embodiments of the present invention.

Hereinafter, the embodiments of the present invention will be explained in detail with reference to the accompanying drawings. In FIG. 1, the schematic structure of a postal matter classifying apparatus 2 (hereinafter, referred to as just the classifying apparatus 2) including a sheet take-out apparatus 1 (hereinafter, referred to as just the take-out apparatus 1) relating to the embodiments of the present invention is shown by a block diagram. The classifying apparatus 2, in addition to the take-out apparatus 1, includes a correction unit 3, a detection unit 4, three classifying gates 5*a*, 5*b*, and 5*c*, a rejection unit 6, a reading unit 7, and three stackers 8*a*, 8*b*, and 8*c*.

Sheets processed by the classifying apparatus 2 are postal matter, though the processed media (that is, sheets) are not limited to postal matter.

Postal matter is set in the sheet take-out apparatus 1 in the stacked state and when the sheet take-out apparatus 1 is operated as described later, are taken out one by one onto the conveying route 9. On the conveying route 9, plurality sets of endless conveying belts not drawn are extended so as to hold the conveying route 9 between them and postal matter is held and conveyed between the conveying belts. The postal matter taken out on the conveying route 9 passes through the correction unit 3 and after the skew thereof is corrected, passes through the detection unit. Here, double conveyance of postal matter, a short gap, and the thickness and height are detected and off-specification postal matter is conveyed to the rejection unit 6 via the first classifying gate 5*a*.

The other postal matter is conveyed to a reading unit 7 further on the downstream side via the classifying gate 6*a*. Here, the information such as the destination is read from the postal matter. The reading unit 7, on the basis of various information read, discriminates the classifying destination of the postal matter. The postal matter passing through the reading unit 7 is distributed in the conveying direction via the classifying gates 5*b* and 5*c* and according to the read results, is classified and stacked on any of the three stackers 8*a*, 8*b*, and 8*c*.

Figure 2:
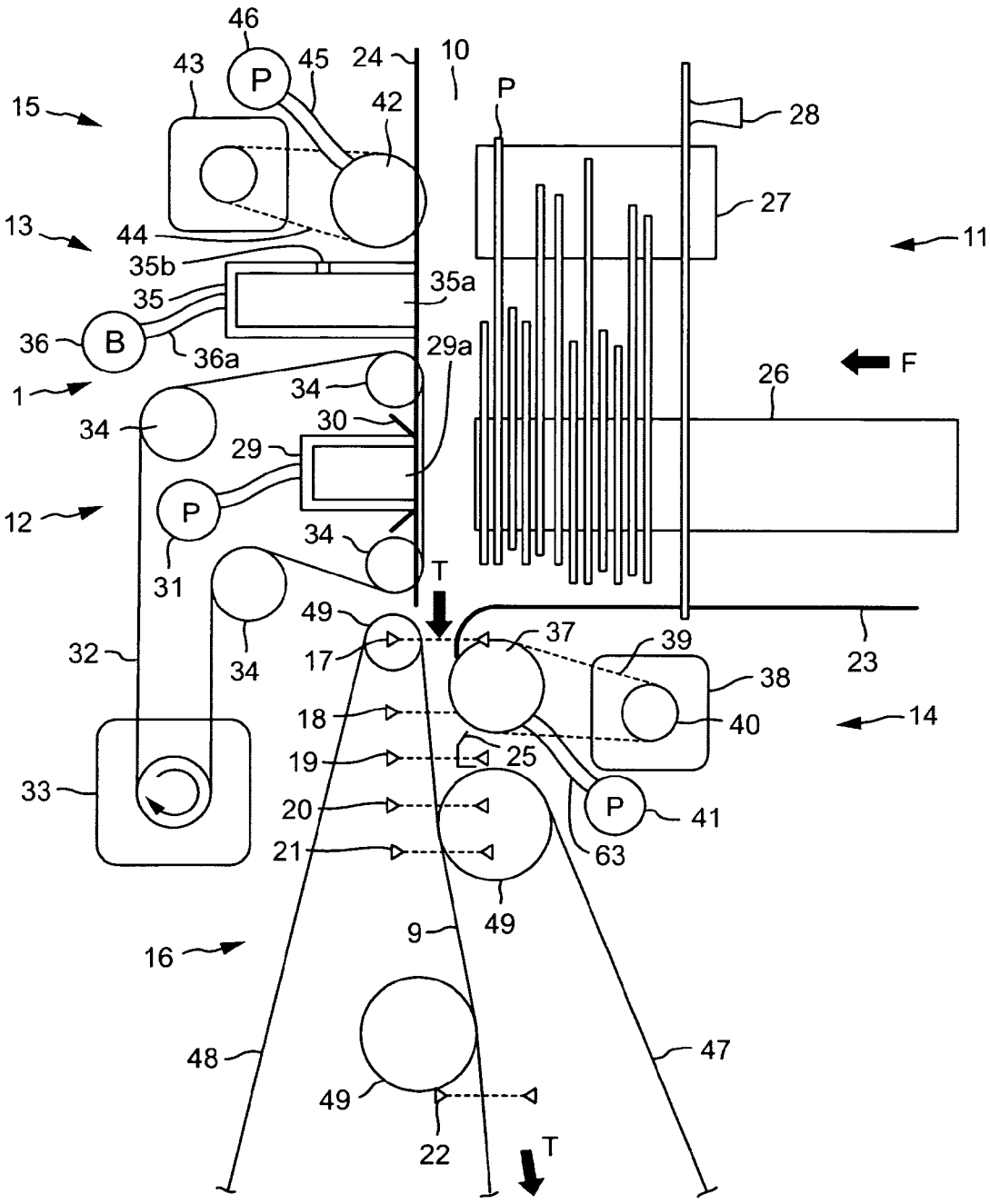
FIG. 2 is a schematic view showing the constitution of the take-out structure incorporated in the postal matter processing apparatus shown in FIG. 1.

FIG. 2 shows a plan view of the sheet take-out apparatus 1 viewed from above. The sheet take-out apparatus 1 includes a supplying structure 11, a take-out structure 12, a suction structure 13, a separation structure 14, an aiding structure 15, and a conveying structure 16. The supplying structure 11 moves a plurality of postal matter P supplied in a batch in the stacked state in the stacking direction (in the direction of the arrow F in the drawing) and supplies the postal matter P at the leading edge thereof in the movement direction to a take-out position 10. The take-out structure 12 takes out the postal matter P supplied to the take-out position 10 on the conveying route 9. The suction structure 13 generates an air current for sucking the postal matter P at the leading edge in the movement direction among the postal matter P supplied via the supplying structure 11 toward the take-out position 10. The separation structure 14 gives separation torque in the opposite direction to the second and subsequent postal matter P taken out by the postal matter P taken out from the take-out position 10, thereby separates the second and subsequent postal matter P from the first postal matter P. The aiding structure 15 acts negative pressure on the postal matter P supplied to the take-out position 10 on the upstream side of the take-out structure 12 in the take-out direction and makes contact with it and rotates, thereby aids the take-out operation of the postal matter P. The conveying structure 16 pulls out the postal matter P passing through the separation structure 14 and conveys further it on the downstream side.

The sheet take-out apparatus 1 includes six sensors 17, 18, 19, 20, 21, and 22 for detecting passing of the postal matter P taken out onto the conveying routed 9 from the take-out position 10. Each of the sensors 17 to 22 includes a light emitting portion and a light receiving portion across the conveying route 9 where the postal matter P passes and if the postal matter P interrupts the optical axis thereof, detects passing of the postal matter P. Furthermore, the sheet take-out apparatus 1 has a plurality of conveying guides 23, 24, and 25 for making contact with the end sides and surface of the postal matter P and guiding the movement thereof.

To the supplying structure 11, a plurality of postal matter P is supplied all in the stacking state and in the standing position. The supplying structure 11 has two floor belts 26 and 27 for making contact with the lower edge of the postal matter P, thereby moving it in the stacking direction (in the direction of the arrow F in the drawing). At the position in contact with the postal matter P at the trailing edge in the movement direction among the plurality of postal matter P, a back-up plate 28 for moving in the direction of the arrow F in cooperation with the floor belt 26, thereby supplying the postal matter P at the leading edge in the movement direction to the takeout position 10 is installed. The backup plate 28 is connected simply to the floor belt 26 and drives the floor belt 26, thereby moves in the direction of the arrow F. Namely, the floor belts 26 and 27 and the backup plate 28 are moved in the direction of the arrow F, thus the postal matter P at the leading edge in the movement direction is sequentially supplied to the take-out position.

The take-out structure 12 includes a chamber 29, a guide 30, and a vacuum pump 31 (or an equivalent article). In the middle of the pipe for connecting the chamber 29 and the vacuum pump 31, an electromagnetic valve not drawn for turning on or off negative pressure is installed. The take-out structure 12 includes an endless taking-out belt 32 that at least a portion in a fixed region moves in the take-out direction (in the direction of the arrow T shown in the drawing) of the postal matter P along the take-out position 10 and a motor 33 for driving the taking-out belt 32.

The taking-out belt 32 has many absorbing holes not drawn and so that at least a part of them moves in the direction of the arrow T shown in the drawing along the take-out position 10, is wound and stretched round a plurality of rollers 34. The guide 30 is arranged at the opposite position to the take-out position 10 inside and across the taking-out belt 32 and has a plurality of silts not drawn extending in the direction of the arrow T. The chamber 29 is arranged on the back side of the guide 30, that is, at the opposite position to the take-out position 10 across the taking-out belt 32 and the guide 30. The chamber 29 has an opening 29*a* interconnecting to the slits of the guide 30 and the absorbing holes of the belt 32.

If the vacuum pump 31 is operated to evacuate the chamber 29, on the postal matter P supplied to the take-out position 10 via the opening 29*a* of the chamber 29 opposite to the back of the guide 30, the plurality of slits (not drawn) of the guide 30, and many absorbing holes (not drawn) of the taking-out belt 32 moving in the direction of the arrow T, negative pressure is acted. If the negative pressure is acted on the postal matter P, the postal matter P is absorbed to the surface of the taking-out belt 32 and in correspondence to the movement of the taking-out belt 32, is taken out from the take-out position 10 onto the conveying route 9.

At this time, to absorb the postal matter P to the taking-out belt 32, it is a condition that the opening 29*a* of the chamber 29 of the take-out structure is closed off by the postal matter P. If the opening 29*a* is closed off by the postal matter P, the inner pressure of the chamber 29 becomes negative and absorbing force is generated. The negative pressure generated on the surface of the taking-out belt 32 acts only on the postal matter P at the leading edge in the movement direction, so that basically, only one postal matter P is taken out.

The suction structure 13 includes a suction chamber 35 arranged on the back side of the conveying guide 24 for the take-out position 10 and a blower 36 (or an equivalent article) for sucking air inside the suction chamber 35. In the middle of a pipe 36*a* for connecting the suction chamber 35 and the blower 36, a suction valve 51 (shown in FIG. 9) is attached. The suction chamber 35, between the take-out structure 12 aforementioned and the aiding structure 15 which will be described later, in the posture that an opening 35*a* (suction hole) thereof is opposite to the back of the guide 24, is arranged in the neighborhood of the take-out position 10. Further, the guide 24, in accordance with the width of the opening 35*a* of the suction chamber 35, has a plurality of holes not drawn.

If the blower 36 is operated to open the valve, the suction chamber 35 is evacuated internally and the air at the take-out position 10 is sucked via the opening 35*a* of the suction chamber 35 and the plurality of holes of the guide. By doing this, an air current in the direction of attracting the postal matter P to the take-out position 10 is generated, thus the postal matter P closest to the take-out position 10 is sucked to the take-out position 10. After the postal matter P sucked to the take-out position 10 is taken out, the next postal matter P is sucked toward the take-out position 10. Namely, since the suction structure 13 is installed, the postal matter P to be taken out next can be supplied quickly to the take-out position 10. Therefore, even if the supply force of the postal matter P by the supplying structure 11 is decreased, only the postal matter P at the edge in the stacking direction can be always stably supplied quickly to the take-out position 10.

The separation structure 14 is installed on the opposite side of the take-out structure 12 for the conveying route 9 extending on the downstream side (downward in FIG. 2) of the take-out position 10. The separation structure 14 acts negative pressure on the postal matter P conveyed through the conveying route 9 from the opposite side of the take-out structure 12 and simultaneously gives separation force in the opposite direction of the take-out direction of the postal matter P to it. Namely, the separation structure 14 is operated, thus even if the second and subsequent postal matter P are taken out by the postal matter P taken out from the take-out position 10, by the aforementioned negative pressure and separation force, the second and subsequent postal matter P are stopped or are retuned in the opposite direction, thereby are separated from the first postal matter P.

Figure 3:
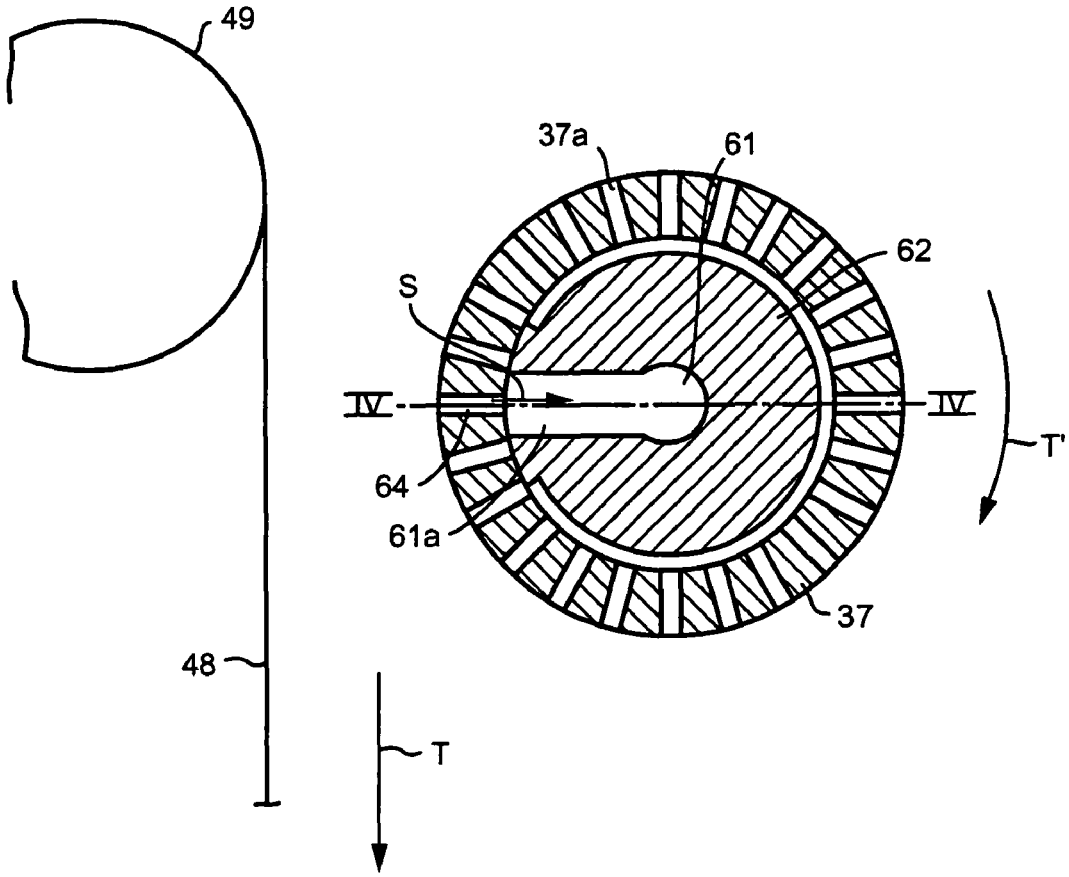
FIG. 3 is a partially enlarged cross sectional view for explaining the function of the separation roller incorporated in the take-out structure shown in FIG. 2.
Figure 4:
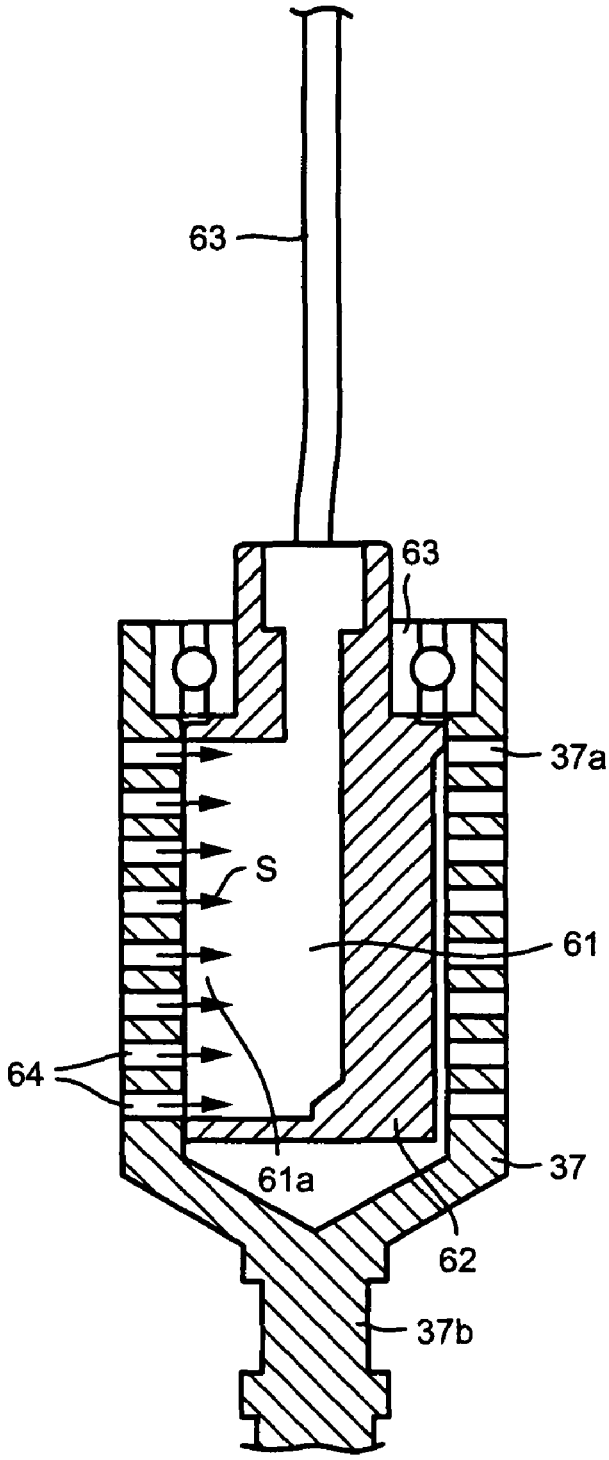
FIG. 4 is a cross sectional view the separation roller which is cut along the line IV-IV shown in FIG. 3.

More in detail, the separation structure 14, as shown in the partially enlarged section in FIG. 3, has an almost cylindrical separation roller 37 installed rotatably in both forward and backward directions in the take-out direction (in the direction of the arrow T) of the postal matter P. The separation roller 37, as shown also in FIG. 4, is a rotary shaft fixedly attached to the conveying route 9, that is, is attached rotatably to the outside of a cylindrical body 62 having a chamber 61, which will be described later, via a bearing 63 and has many absorbing holes 37*a* passing through so as to connect the inner peripheral surface and outer peripheral surface thereof throughout its periphery.

The separation roller 37 is formed by a rigid body such as an almost cylindrical metallic material and is positioned and arranged at the position where the outer peripheral surface thereof is exposed on the conveying route 9. The cylindrical body 62 as a rotary shaft has the chamber 61 for generating negative pressure and is positioned and fixed in the posture that an opening 61*a* of the chamber 61 is directed toward the conveying route 9. Further, FIG. 4 is a cross sectional view along the broken-out line IV-IV shown in FIG. 3.

The separation structure 14 includes a motor 38 for rotating the separation roller 37 in both forward and backward directions and an endless timing belt 39 for transferring the drive force by the motor 38 to the separation roller 37. The timing belt 39 is wound and stretched round a timing pulley 40 fixed to the rotary shaft of the motor 38 and a pulley not drawn fixed to a rotary shaft 37*b* (refer to FIG. 4) of the separation roller 37. Furthermore, the separation structure 14 has a vacuum pump 41 (or an equivalent article) connected to the chamber 61 of the cylindrical body 62 with the separation roller 37 attached rotatably via a pipe 63.

If the vacuum pump 41 is operated to evacuate the chamber 61, via the opening 61*a* of the chamber 61 and a specific absorbing hole 64 opposite to the opening 61*a* among many absorbing holes 37*a* of the separation roller 37, negative pressure (the arrow S in the drawing) is acted on the surface of the postal matter P passing through the conveying route 9. If the negative pressure is acted on the surface of the postal matter P, the postal matter P is absorbed to the outer peripheral surface of the separation roller 37. In this case, when the separation roller 37 is rotating, also to the postal matter P absorbed to the outer peripheral surface of the separation roller 37, conveying force in the rotational direction of the separation roller 37 is given.

On the other hand, the motor 38, basically, drives the separation roller 37 so as to give always fixed separation torque in the opposite direction (in the direction of the arrow T' shown in the drawing) of the take-out direction to the separation roller 37. The separation torque, when one postal matter P is conveyed through the conveying route 9, is set to such a level that the separation roller 37 absorbing the one postal matter P can be accompanied by the postal matter P in the conveying direction. And, the separation torque, when a plurality of postal matter P are taken out on the conveying route 9 in the stacking stage, is set to such a level that the second and subsequent postal matter P on the side of the separation roller 37 are stopped or are returned in the opposite direction and can be separated from the first postal matter P.

In FIG. 2 again, the aiding structure 15, above the suction structure 13 in the drawing, that is, in the take-out direction (in the direction of the arrow T) of the sheets P, is arranged on the upstream side of the suction structure 13. The aiding structure 15 has almost the same structure as that of the separation structure 14. Namely, the aiding structure 15 includes an aiding roller 42 installed rotatably in the take-out direction T of the postal matter P, a motor 43 for rotating the aiding roller 42, a timing belt 44 for transferring the drive force of the motor 43 to the aiding roller 42, and a vacuum pump 46 for generating negative pressure on the surface of the aiding roller 42. A pipe 45 of the vacuum pump 46 is connected to a chamber not drawn here.

The aiding structure 15 rotates and stops the aiding roller 42 in both forward and backward directions at a desired speed and turns on or off the negative pressure by the vacuum pump 46, thereby aids the take-out operation and separation operation of the postal matter P. For example, when taking out the postal matter P supplied to the take-out position 10 by the take-out structure 12, the aiding structure 15 acts the negative pressure on the trailing edge side of the postal matter P in the take-out direction, absorbs it, then rotates in the forward direction T, and aids the take-out of the postal matter P. By doing this, for example, when taking out large postal matter P comparatively heavy in weight, the aiding structure 15 can give larger and more stable conveying force than that when taking out ordinary postal matter P and the take-out operation of the postal matter P can be stabilized.

When the first postal matter P is taken out by the take-out structure 12, after it moves to the position where the trailing edge of the postal matter P in the take-out direction does not interfere with the aiding roller 42, the aiding structure 15 permits the trailing edge of the second postal matter P supplied next to the take-out position to be absorbed to the aiding roller 42, gives desired torque in the opposite direction, and can brake it. Therefore, the separation structure 14 and aiding structure 15 can prevent double conveyance of the postal matter P in cooperation with each other. In this case, by controlling the torque in the opposite direction to be given to the aiding roller 42 and controlling the braking time, the gap and pitch of the postal matter P to be taken out from the take-out position 10 onto the conveying route 9 can be controlled.

Figure 8:
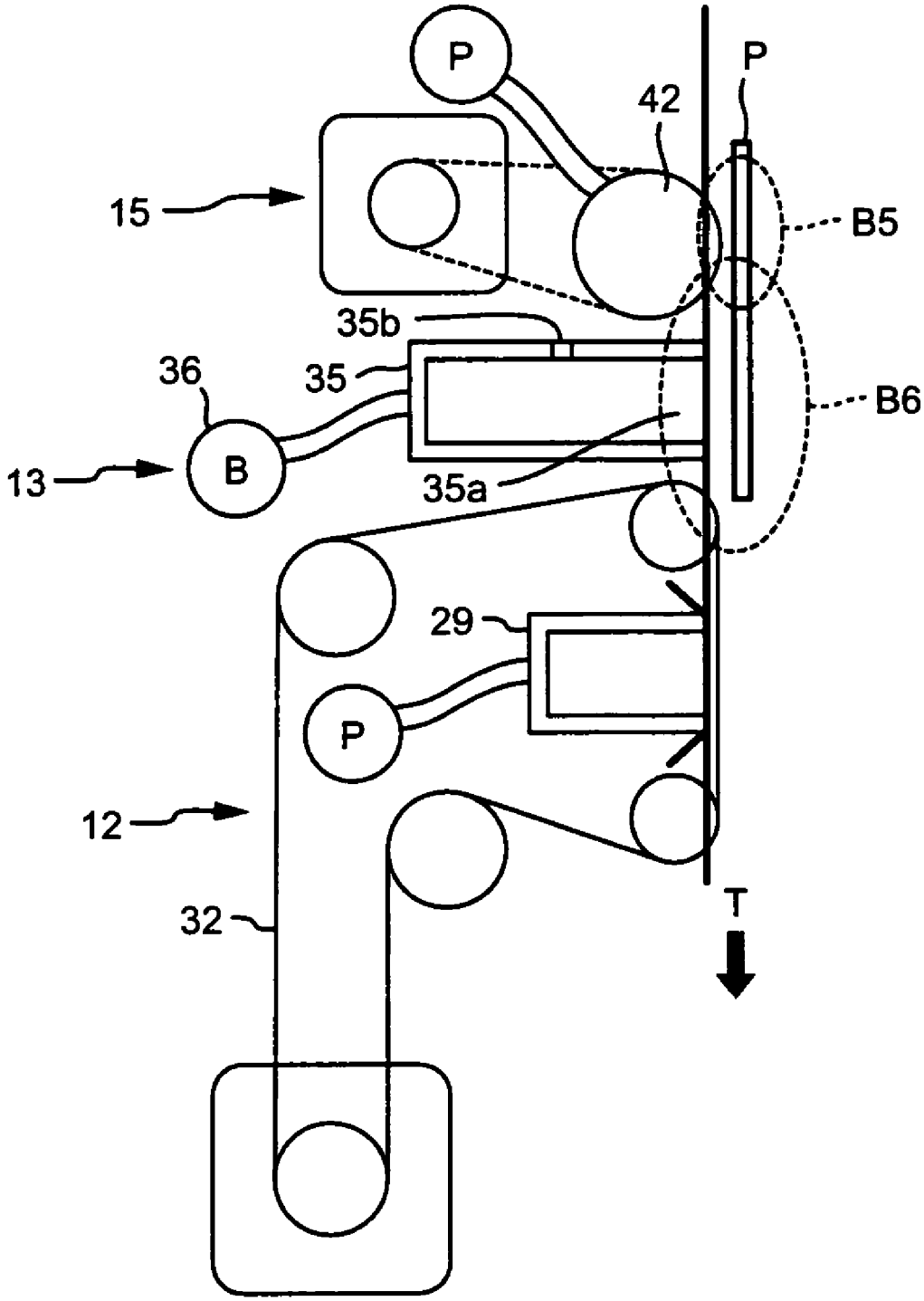
FIG. 8 is an operation illustration for explaining an example of postal matter unable to take out.

Furthermore, as shown in FIG. 8, when the postal matter P with a comparatively short length in the take-out direction is absorbed to the opening 35*a* of the suction chamber 35 of the suction structure 13 and is stopped in the state that it does not reach the chamber 29 of the take-out structure 12, the possibility of unable to take out the postal matter P is high. In that case, the aiding roller 24 rotates in the state that the postal matter P is acted on negative pressure and is absorbed and functions so as to send the postal matter P in the forward direction T. Further, at this time, the absorbing force by the suction structure 13 absorbing the postal matter P prevents the take-out of the postal matter P, so that it is desirable to stop the air current generated from the suction structure 13.

The conveying structure 16 has two conveyor belts 47 and 48 extending so as to hold the conveying route 9 extending on the downstream side of the take-out structure 12 between both sides thereof. Each of the conveyor belts 47 and 48 is wound and stretched round a plurality of rollers. The conveyor belt 48 on the left in the drawing is extended up to the position opposite to the separation structure 14 via the conveying route 9. The conveyor belt 47 on the right in the drawing is started from the downstream side of the separation structure 14. The postal matter P conveyed in the direction of the arrow T shown in the drawing via the conveying route 9, since the leading edge thereof in the conveying direction is received, held, and restricted between the two sets of the conveyor belts 47 and 48, is conveyed furthermore on the downstream side due to movement of the conveyor belts 47 and 48. The two conveyor belts 47 and 48 move at a slightly higher speed than the speed of the taking-out belt 32 of the take-out structure 12, and the leading edge of the postal matter P conveyed via the conveying route 9 is held and restricted by the conveyor belts 47 and 48, and then is conveyed so as to be pulled out.

Hereinafter, the take-out operation of the postal matter P by the sheet take-out apparatus 1 having the aforementioned structure will be explained. Firstly a plurality of postal matter P to be processed are all supplied onto the two floor belts 26 and 27 of the supplying structure 11 in the standing position, and the back-up plate 28 is moved in the direction of the arrow F together with the two belts 26 and 27, and the postal matter P is supplied to the take-out position 10. The supplying structure 11 is operated whenever the postal matter P is taken out by the take-out structure 12 and is operated always so as to supply the postal matter P at the end in the stacking direction to the take-out position 10.

During the supply operation, the suction structure 13 is operated, and the air current is acted on the postal matter P closest to the take-out position 10, and the postal matter P at the end is sucked quickly to the take-out position 10. The postal matter P sucked and supplied to the take-out position 10 is absorbed by the negative pressure generated on the surface of the taking-out belt 32 of the take-out structure 12, is taken out onto the conveying route 9, and is conveyed in the direction of the arrow T by the conveying structure 16 via the separation structure 14.

Figure 5:
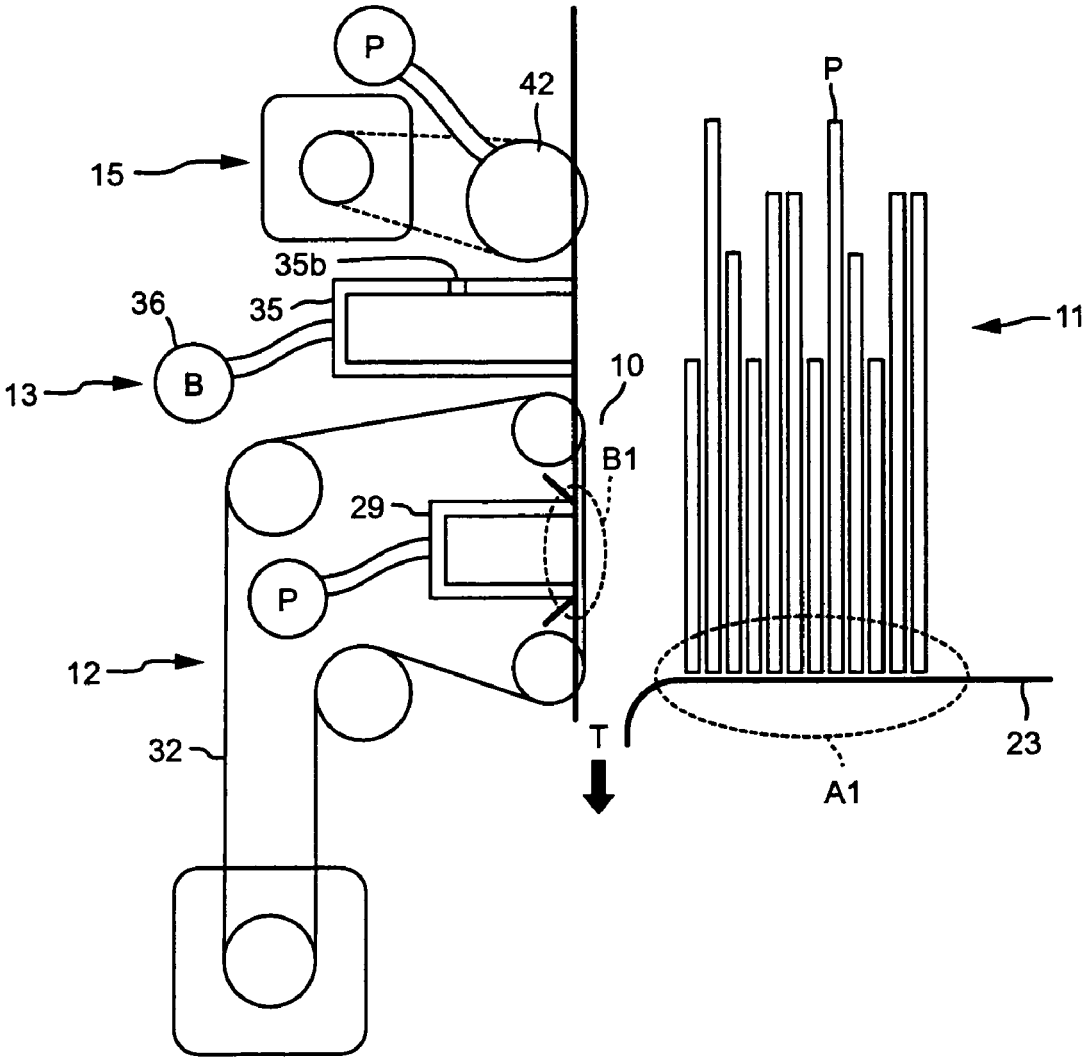
FIG. 5 is an operation illustration showing the status when postal matter is supplied with arranged properly to the supplying structure incorporated in the take-out structure shown in FIG. 2.

For example, as shown by a dotted line A1 in FIG. 5, when the leading edges of, all the postal matter P in the take-out direction strike against the guide 23, are arranged properly, and then are supplied to the supplying structure 11, the first postal matter P closest to the take-out position 10 is absorbed to the taking-out belt 32 at the position indicated by a dotted line B1 and is taken out normally. However, as shown by a dotted line A2 in FIG. 6, when the postal matter is supplied to the supplying structure 11 in the state that the leading edges in the take-out direction are not arranged properly, the postal matter P closest to the take-out position 10 may not be absorbed normally to the taking-out belt 32. Namely, the opening 29*a* of the chamber 29 is not closed (the inside does not become negative in pressure) at the position indicated by a dotted line B2 and there is a fear that it may not be absorbed and conveyed.

Figure 6:
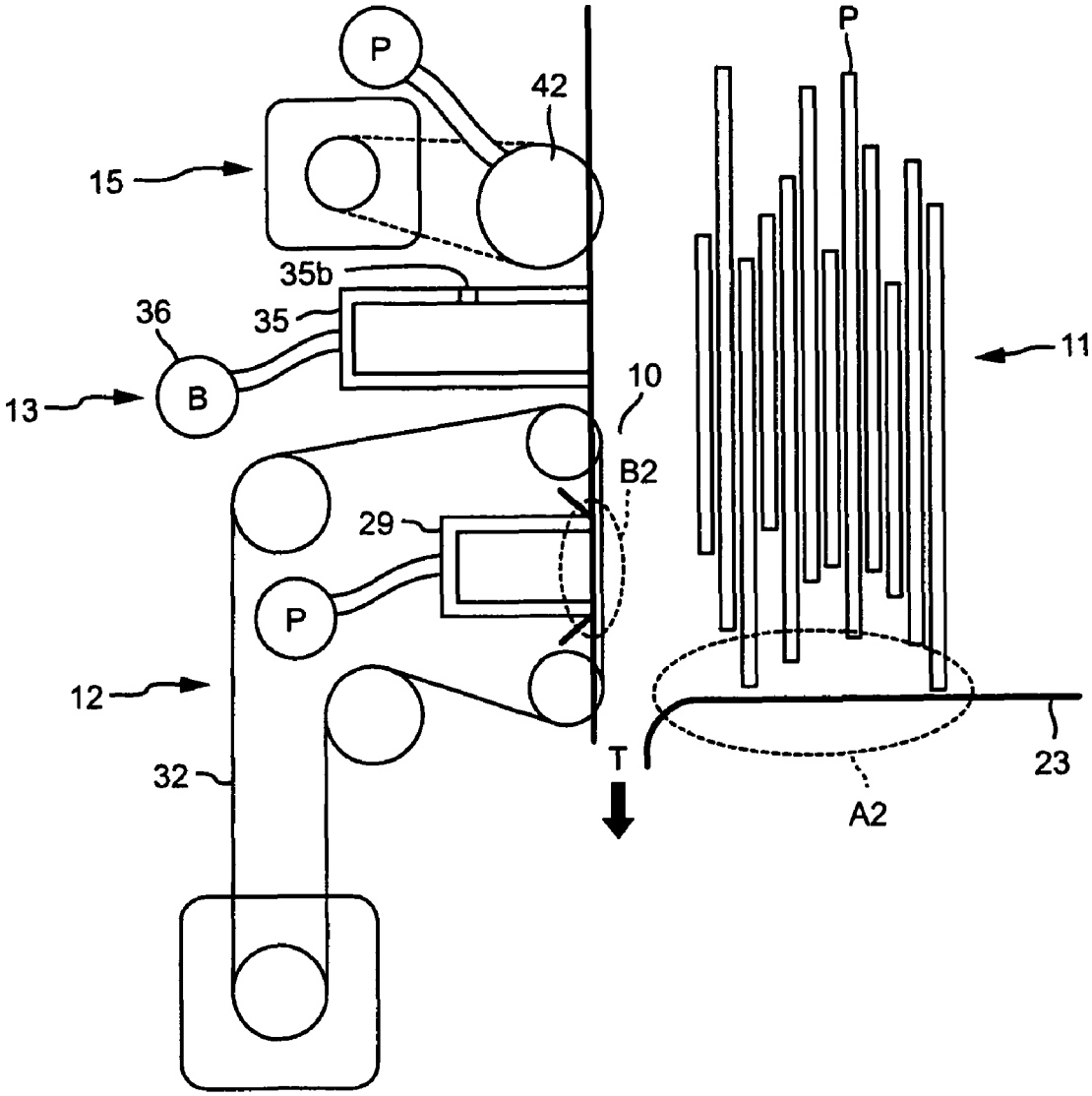
FIG. 6 is an operation illustration showing the status when postal matter is supplied with unarranged properly to the supplying structure.
Figure 7:
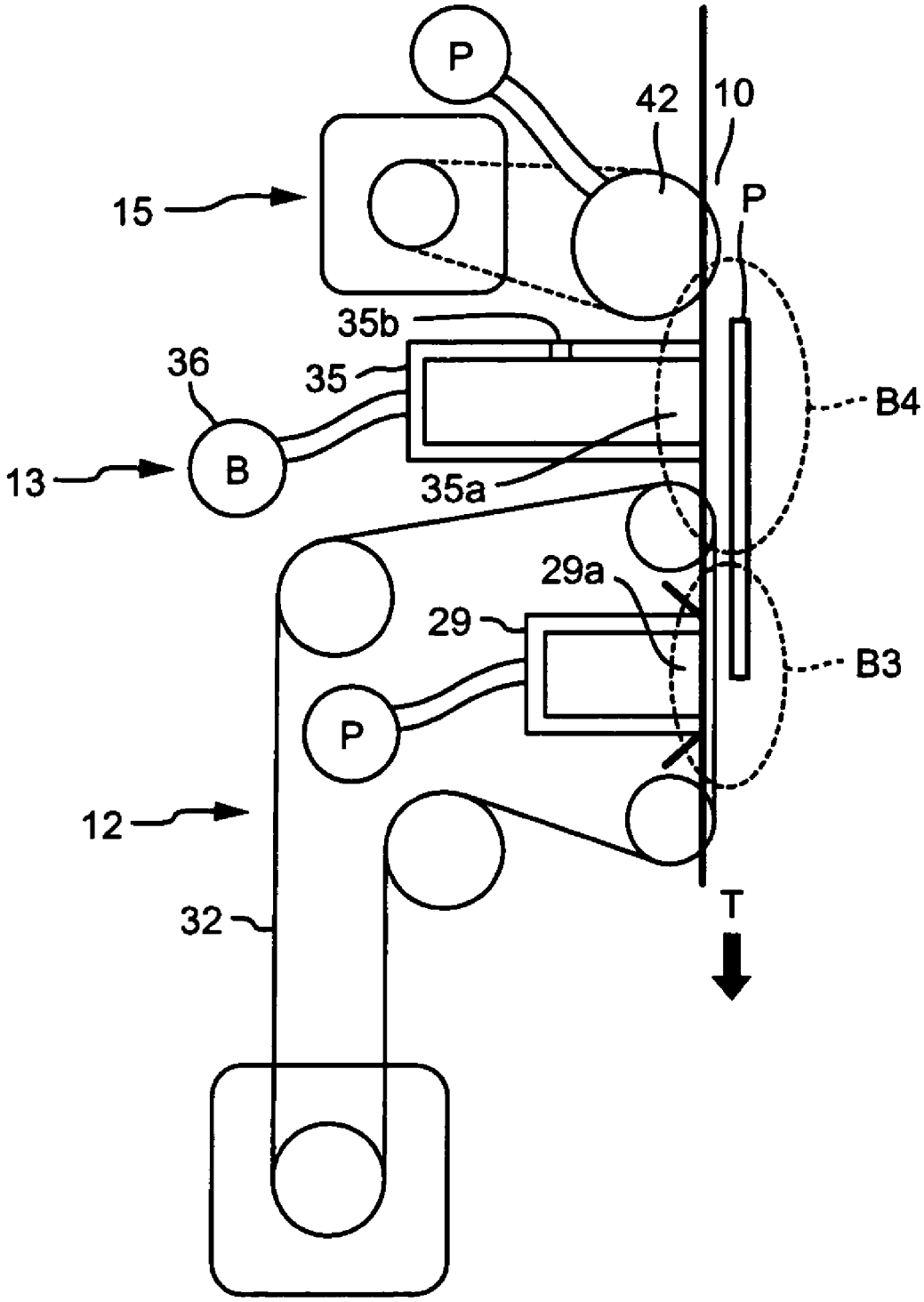
FIG. 7 is an operation illustration for explaining an example of postal matter unable to take out.

Namely, in the example shown in FIG. 6, the distance between the leading edge of the postal matter P in the take-out direction which is closest to the take-out position 10 and comparatively short and the guide 23 is long. Therefore, when the postal matter P, as shown by a dotted line B3 in FIG. 7, is sucked to the take-out position 10 by the action of the suction structure 13, the postal matter P does not close completely the opening 29*a* of the chamber 29 of the take-out structure 12. In this case, the chamber 29 does not become internally negative in pressure and no absorbing force is generated, so that the postal matter P is not absorbed to the taking-out belt 32, thereby cannot be taken out.

Particularly, in this case, as shown by a dotted line B4 in FIG. 7, the postal matter P closest to the take-out position 10 closes the opening 35*a* of the suction chamber 35 of the suction structure 13, so that the postal matter P is stuck to the opening 35*a* of the suction chamber 35. If the postal matter P is stuck to the opening 35*a* of the suction chamber 35, the postal matter P cannot be taken out only by the frictional force generated between the surface of the taking-out belt 32 and the postal matter P. Therefore, the postal matter P stays at the position drawn. In the suction chamber 35, in addition to the opening 35*a*, a suction hole 35*b* for venting air is formed, though when the blower 36 is operated continuously, the negative pressure in the suction chamber 35 is not eliminated.

If the postal matter P stays at the position shown in FIG. 7 in this way, the postal matter P cannot be taken out. Furthermore, the second and subsequent postal matter P cannot be taken out and even if the second postal matter P is absorbed to the taking-out belt 32 and is taken out prior to the first postal matter P, due to sticking of the staying first postal matter P, the take-out operation for the second and subsequent postal matter P becomes unstable.

As shown in FIG. 8, even if the trailing edge (a dotted line B5) of the postal matter P in the take-out direction is at the position where it is in contact with the aiding roller 42, as shown by a dotted line B6, if the opening 35*a* of the suction chamber 35 is closed by the postal matter P, the absorbing force acted on the postal matter P by the suction structure 13 is stronger. Therefore, even if the aiding roller 42 is intended to rotate in the forward direction by generating negative pressure on the peripheral surface of the aiding roller 42 and send the trailing edge of the postal matter P in the take-out direction, the postal matter P cannot be taken out. Even if the aiding roller 42 is changed to a rubber roller and sends the trailing edge of the postal matter P in the forward direction with strong force, there are possibilities that the postal matter P may be buckled or may sustain soil damage.

In this embodiment, to solve the problem of sticking of the postal matter P, the following advice is made.

EMBODIMENT 1

Figure 9:
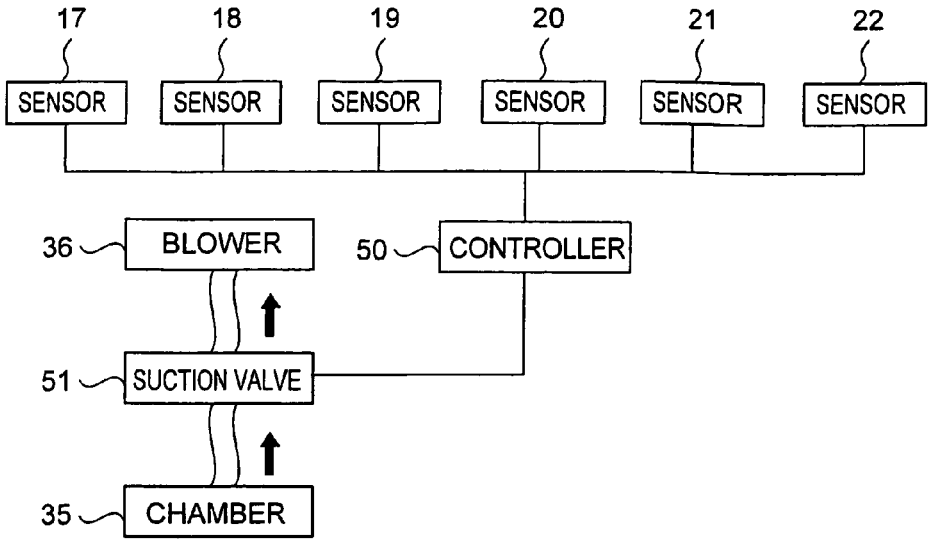
FIG. 9 is a block diagram of the control system relating to the first embodiment for controlling the operation of the take-out apparatus shown in FIG. 2.

FIG. 9 shows a block diagram of the control system for controlling the operation of the sheet take-out apparatus 1. To a controller 50 of the sheet take-out apparatus 1, the six sensors 17 to 22 installed on the conveying route 9 are connected. Further, to the controller 50, the suction valve 51 installed in the middle of the pipe 36*a* for connecting the suction chamber 35 of the suction structure 13 and the blower 36 is connected. The suction valve 51 is an electromagnetic valve for switching the air flow path and is operated under the control of the controller 50. In other words, the controller 50, on the basis of the passing information of the postal matter P detected by the sensors 17 to 22, controls to turn on or off suction force generated by the blower 36 acting on the opening 35*a* of the suction chamber 35.

More in detail, if the controller 50 gives an instruction of suction start to the suction valve 51 with the blower kept operated, by the suction operation of the blower 36, the air in the suction chamber 35 is sucked and the suction force is acted on the postal matter P. On the other hand, if the controller 50 gives an instruction of suction stop to the suction valve 51, the blower 36 is operated, though the air in the suction chamber 35 is not sucked, and the suction force is not acted on the postal matter P.

Figure 10:
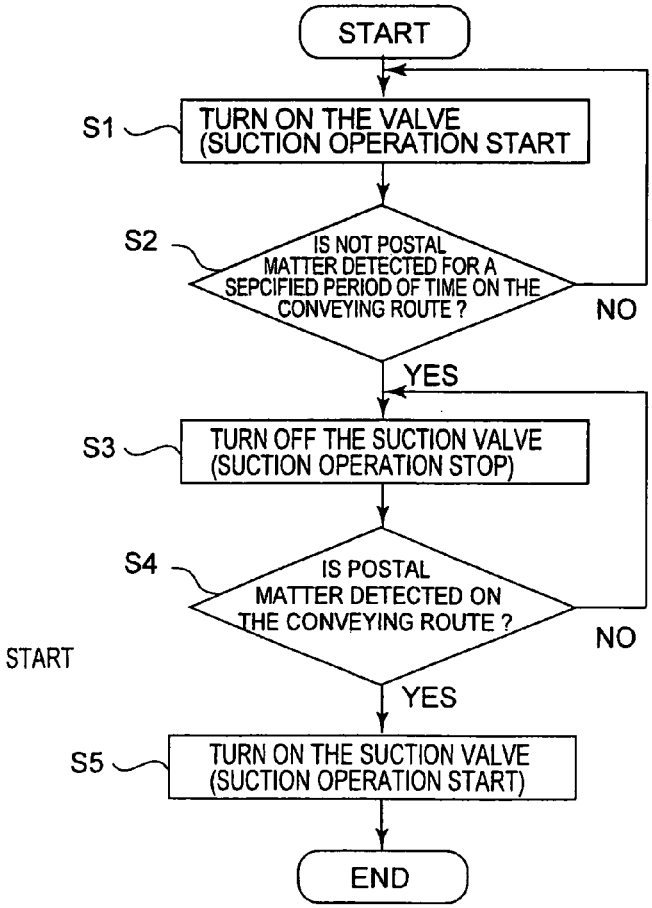
FIG. 10 is a flow chart for explaining the operation of the controller shown in FIG. 9.

FIG. 10 shows a flow chart for explaining the aforementioned operation by the controller 50. The controller 50 firstly permits the vacuum pump 31, blower 36, vacuum pump 41, and vacuum pump 46 to operate, turns on the suction valve 51, and starts the suction operation (Step S1). At this time, the controller 50 permits the supplying structure 11 to operate and start to supply the postal matter P, permits the take-out structure 12 to operate and move the taking-out belt 32, and permits the separation structure 14 to operate. By doing this, the postal matter P close to the take-out position 10 is pulled near the taking-out belt 32 and is taken out onto the conveying route 9 by the cooperative operation of the supplying structure 11 and take-out structure 12.

After the suction valve 51 is turned on as mentioned above and the take-out operation for the postal matter P is started, the controller 50 monitors the conveying condition of the postal matter P via the six sensors 17 to 22 and judges whether the postal matter P is taken out normally or not (Step S2). As a result of the judgment, when the postal matter P is not detected by any of the sensors within a specified period of time (YES at Step S2), that is, when the postal matter P is not taken out, the controller 50 judges that there are possibilities that the postal matter P may be stuck to the suction chamber 35 and stay there and turns off the suction valve 51 (Step S3).

If the suction valve 51 is turned off, the suction force to the postal matter P by the suction structure 13 is not acted and the restriction force to the postal matter P by the suction structure 13 is canceled. By doing this, due to the frictional force between the postal matter P and the taking-out belt 32 moving in contact with the postal matter P, the take-out of the postal matter P is restarted. Namely, when the postal matter P is taken out normally without being absorbed to the suction chamber 35, the following relationship is held:

[Absorbing force of belt (large)+frictional force of belt (small)]>[resistant force by suction (medium)]

However, as shown in FIG. 7, when the postal matter P does not reach the opening 29*a*, the postal matter P is absorbed to the suction chamber 35 and the following relationship is held:

[Absorbing force of belt (non)+frictional force of belt (small)]<[resistant force by suction (medium)]

and the postal matter P cannot be conveyed.

However, as described in this embodiment, if the suction is turned off when the postal matter P is stuck, the following relationship can be realized:

[Absorbing force of belt (non)+frictional force (small)]>[resistant force by suction (non)]

and the postal matter P can be taken out normally.

The suction valve 51 is turned off at Step S3, and then the controller 50 judges whether the sticking of the postal matter P is eliminated via the six sensors 17 to 22 or not (Step S4) and if the controller 50 judges that any of the sensors detects the postal matter P and the take-out of the postal matter P is restarted (YES at Step S4), it turns on the suction valve 51 and restarts the suction operation for the second and subsequent postal matter P (Step S5).

As mentioned above, according to this embodiment, when the postal matter P at the take-out position 10 is stuck to the suction chamber 35 and stays there, under the condition that the take-out of the postal matter P is not confirmed, the suction valve 51 is turned off and the absorbing force by the suction chamber 35 is eliminated. Therefore, defective take-out due to sticking of the postal matter P can be prevented a stable take-out operation can be performed. Particularly, according to this embodiment, even when the leading edge of the postal matter P at the take-out position 10 and the guide 23 are separated from each other, the postal matter P can be taken out. Therefore, even if the posture of the postal matter P supplied to the supplying structure 11 is varied, a stable take-out operation can be realized. In other words, when the postal matter P is stuck as in this embodiment, the suction is stopped, and it is made possible to take out the postal matter P, thus the postal matter P can be supplied to the supplying structure 11 without minding the supply posture of the postal matter P and the convenience can be improved.

EMBODIMENT 2

Figure 11:
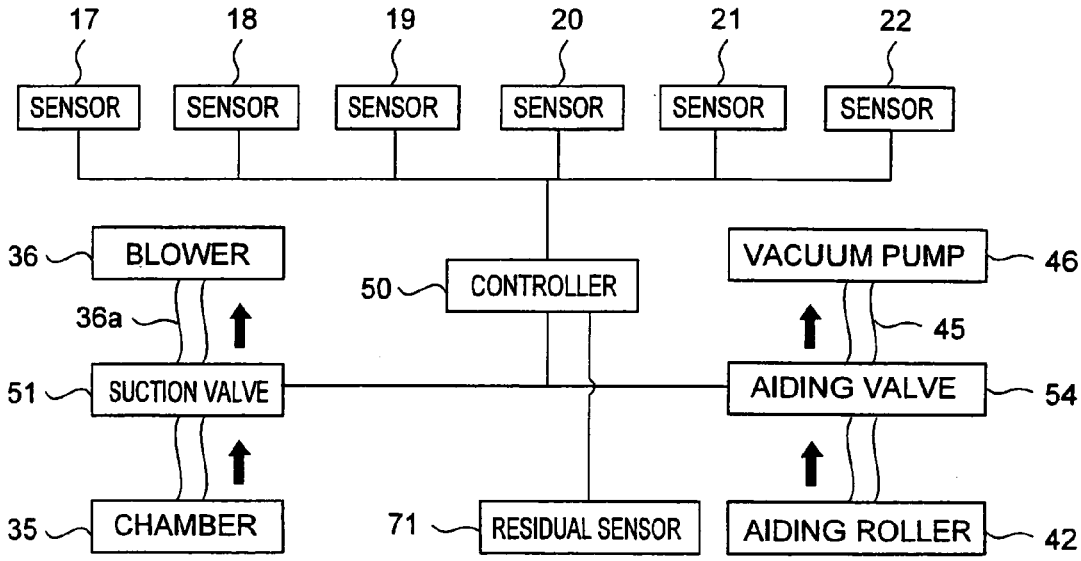
FIG. 11 is a block diagram of the control system relating to the second embodiment for controlling the operation of the take-out apparatus shown in FIG. 2.

FIG. 11 shows a block diagram of the control system for controlling the operation of the sheet take-out apparatus 1. To the controller 50 of the sheet take-out apparatus 1, the six sensors 17 to 22 installed on the conveying route 9 and a residual sensor 71 are connected. The residual sensor 71 detects existence of the postal matter P supplied to the supplying structure 11. Further, to the controller 50, the suction valve 51 installed in the middle of the pipe 36*a* for connecting the suction chamber 35 of the suction structure 13 and the blower 36 is connected. Furthermore, to the controller 50, an aiding valve 54 installed in the middle of the pipe 45 for connecting the chamber of the aiding roller 42 of the aiding structure 15 and the vacuum pump 46 are connected. The suction valve 51 and aiding valve 54 are an electromagnetic valve for switching the air flow path and under the control of the controller 50, control to turn on or off suction force generated by the blower 36 and negative pressure generated by the vacuum pump 46.

Figure 12:
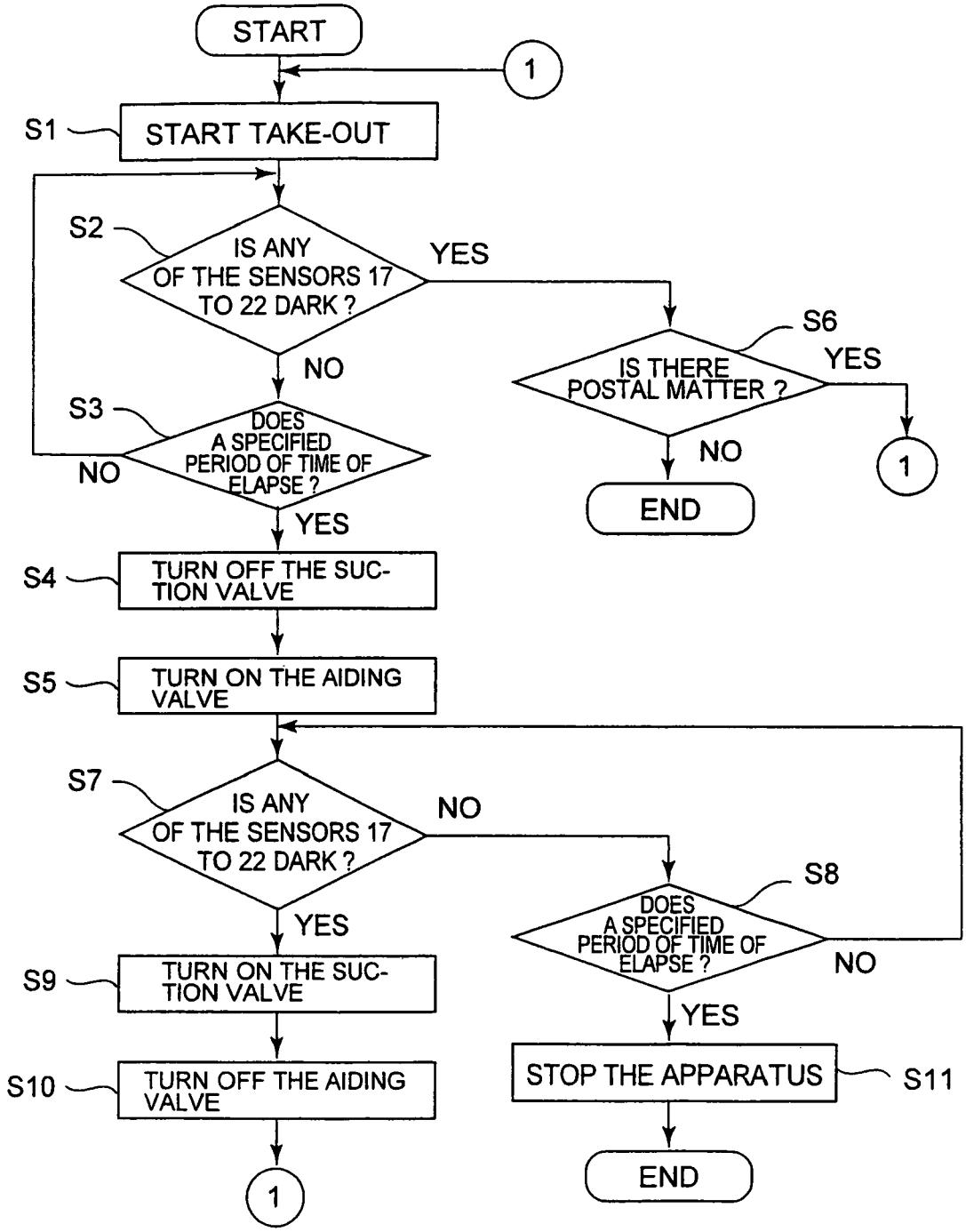
FIG. 12 is a flow chart for explaining the operation of the controller shown in FIG. 11.

FIG. 12 shows a flow chart for explaining the operation by the controller 50. The controller 50 firstly permits the vacuum pump 31, blower 36, vacuum pump 41, and vacuum pump 46 to operate, turns off the aiding valve 54, simultaneously turns on the suction valve 51, and starts the suction operation. Further, the controller 50 permits the supplying structure 11 to operate and start to supply the postal matter P, permits the take-out structure 12 to operate and move the taking-out belt 32, and permits the separation structure 14 to operate. By doing this, the postal matter P close to the take-out position 10 is pulled near the taking-out belt 32 and the take-out operation for the postal matter P is started by the cooperative operation of the supplying structure 11 and take-out structure 12 (Step S1).

After the suction valve 51 is turned on as mentioned above and the take-out operation for the postal matter P is started, the controller 50 monitors the conveying condition of the postal matter P via the six sensors 17 to 22 (Step S2) and judges whether the postal matter P is taken out normally or not. At this time, the controller 50, when any of the sensors does not become dark even if a specified period of time elapses after start of take-out (NO at Step S2, YES at Step S3), judges that there are possibilities that the postal matter P may be stuck to the suction chamber 35 and stay there and turns off the suction valve 51 (Step S4). Simultaneously, the controller 50 turns on the aiding valve 54 (Step S5).

On the other hand, at Step S2, if the controller 50 judges that any of the sensors 17 to 22 becomes dark within the specified period of time and the postal matter P is taken out normally onto the conveying route 9 (YES at Step S2), the controller 50 checks the output of the residual sensor 71, under the condition that there is the postal matter P to be processed in the supplying structure 11 (YES at Step S6), returns to the process at Step S1, and continues the take-out operation for the postal matter P. Further, the controller 50, when judging at Step S6 that there is no postal matter P in the supplying structure 11 (NO at Step S6), finishes the operation.

As explained at Step S4, if the suction valve 51 is turned off when the postal matter P is stuck to the suction chamber 35, the suction force to the postal matter P by the suction structure 13 does not act and the restriction force to the postal matter P by the suction structure 13 is canceled. In this state, the taking-out belt 32 moving in the direction of the arrow T is in contact with the postal matter P, so that the take-out of the postal matter P is restarted by the frictional force between the postal matter P and the taking-out belt 32. Further, at this time, if the aiding valve 54 is turned on as at Step S5, negative pressure is generated on the peripheral surface of the aiding roller 42 and if the aiding roller 54 is rotated in the direction of the arrow T, the trailing edge of the postal matter P in the take-out direction is pressed in the take-out direction, and the take-out operation for the postal matter P is aided.

Hereafter, the controller 50 judges whether the postal matter P is conveyed normally via the six sensors 17 to 22 or not (Step S7) and under the condition that any of the sensors 17 to 22 becomes dark within the specified period of time (YES at Steps S8 and S7), turns on the suction valve 51 to suck the next postal matter P (Step 9). Simultaneously, the controller 50 turns off the aiding valve 54 (Step S10), returns to Step S1, and starts taking-out of the next postal matter P. On the other hand, as a result of the judgment at Step S8, when any of the sensors 17 to 22 does not become dark even if the specified period of time elapses (NO at Step S7, YES at Step S8), the controller 50 stops the sheet take-out apparatus 1 and removes the postal matter P by an operator's hand operation.

As mentioned above, according to this embodiment, the similar effects as those of the first embodiment aforementioned can be obtained and additionally the aiding roller 42 is functioned, thus the stuck postal matter P can be sent out more surely from the take-out position 10. On the suction chamber 35, in addition to the opening 35*a* which may be closed by the postal matter P, the suction hole 35*b* is formed, so that even if the postal matter P is stuck to the opening 35*a*, if the suction valve 51 is turned off, the negative pressure in the suction chamber 35 is reduced slowly. However, until the negative pressure is eliminated, the postal matter P is stuck to the opening 35*a*, thus the postal matter P cannot be sent out quickly only by the frictional force by the taking-out belt 32. Therefore, when the postal matter P is stuck as in this embodiment, it is effective to function the aiding roller 42 and aid the take-out operation.

EMBODIMENT 3

Figure 13:
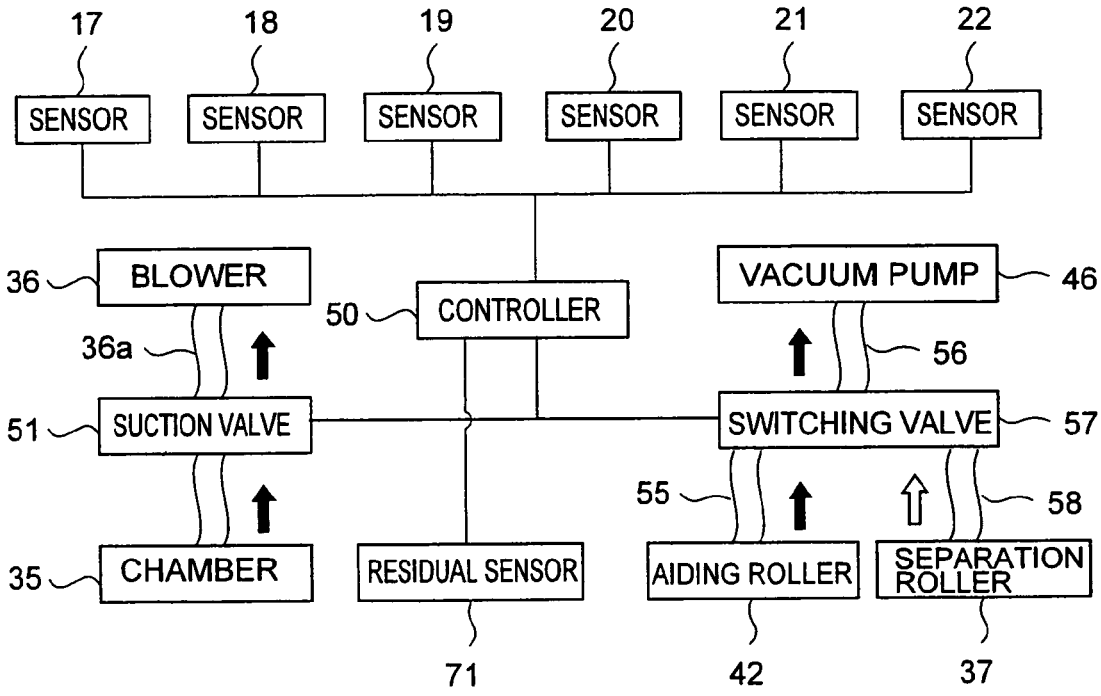
FIG. 13 is a block diagram of the control system relating to the third embodiment for controlling the operation of the take-out apparatus shown in FIG. 2.

FIG. 13 shows a block diagram of the control system for controlling the operation of the sheet take-out apparatus 1. To the controller 50 of the sheet take-out apparatus 1, the six sensors 17 to 22 installed on the conveying route 9 and the residual sensor 71 are connected. The residual sensor 71 detects existence of the postal matter P supplied to the supplying structure 11. Further, to the controller 50, the suction valve 51 installed in the middle of the pipe 36*a* for connecting the suction chamber 35 of the suction structure 13 and the blower 36 is connected. Furthermore, to the controller 50, a switching valve 57 for selectively connecting the convertible vacuum pump 46 to either of the chamber 61 of the separation roller 37 and the chamber of the aiding roller 42 is connected. Further, in this embodiment, the vacuum pump 41 of the separation structure 14 is excluded and the vacuum pump 46 of the aiding structure 15 is utilized.

The suction valve 51 is an electromagnetic valve for switching the air flow path and controls to turn on and off the suction force generated by the blower 36 under the control of the controller 50. The switching valve 57 is connected to the vacuum pump 46 via a pipe 56, is connected to the aiding roller 42 via a pipe 55, and is connected to the separation roller 37 via a pipe 58. However, when the switching valve 57 is switched under the control of the controller 50 and the pipes 56 and 55 are connected, negative pressure is generated on the peripheral surface of the aiding roller 42, and when the pipes 56 and 58 are connected, negative pressure is generated on the peripheral surface of the separation roller 37.

Figure 14:
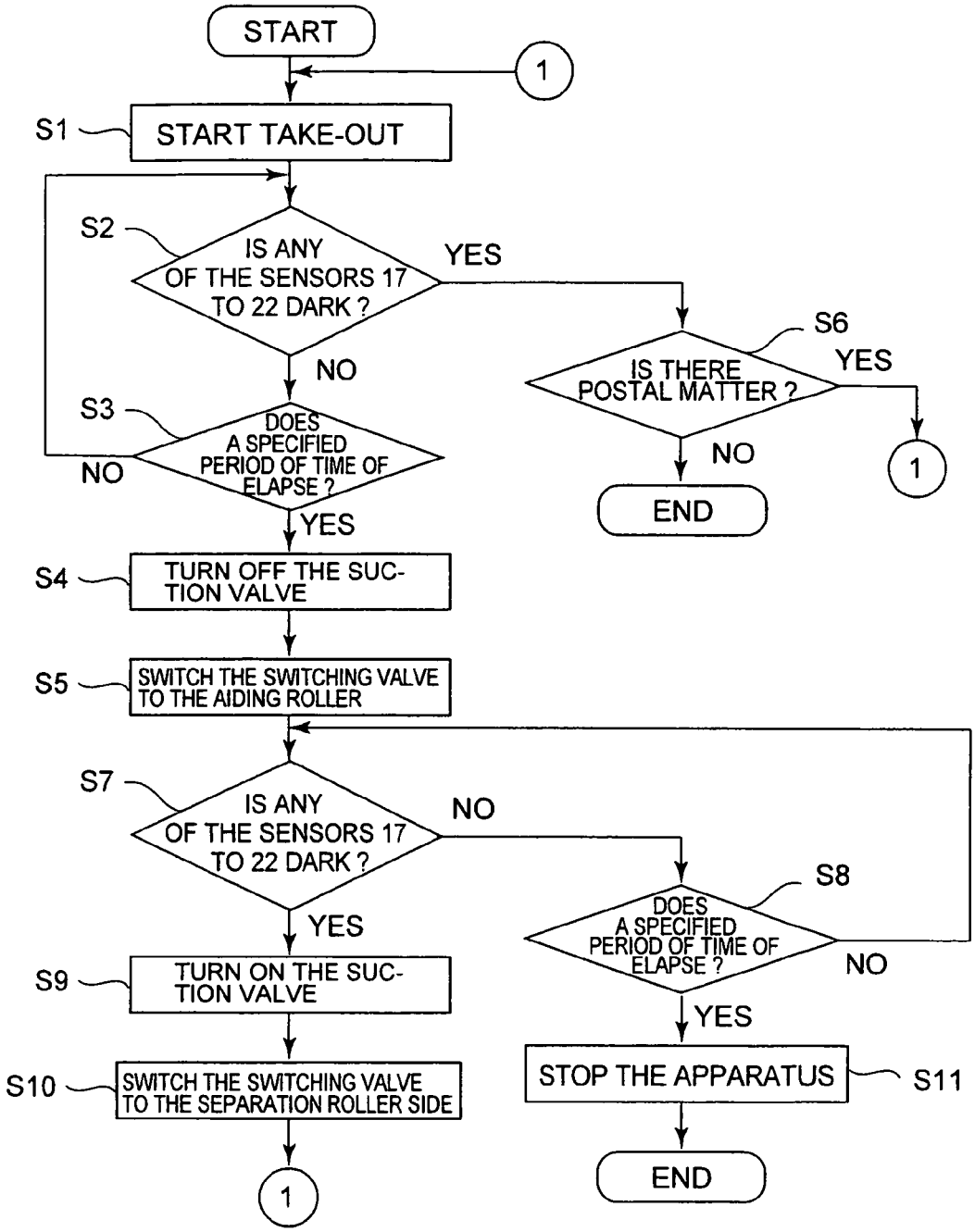
FIG. 14 is a flow chart for explaining the operation of the controller shown in FIG. 13.

FIG. 14 shows a flow chart for explaining the operation of the controller 50. The controller 50 firstly permits the vacuum pump 31, blower 36, and convertible vacuum pump 46 to operate and connects the switching valve 57 to the separation roller 37. Simultaneously, the controller 50 turns on the suction valve 51 to start the suction operation, permits the supplying structure 11 to operate to start to supply the postal matter P, permits the take-out structure 12 to operate to move the taking-out belt 32, and permits the separation structure 14 to operate. By doing this, the postal matter P close to the take-out position 10 is pulled near the taking-out belt 32 and the take-out operation for the postal matter P is started by the cooperative operation of the supplying structure 11 and take-out structure 12 (Step S1). At this time, the separation structure 14 functions as mentioned above and separates other postal matter P taken out by the postal matter P.

After the suction valve 51 is turned on as mentioned above and the take-out operation for the postal matter P is started, the controller 50 monitors the conveying condition of the postal matter P via the six sensors 17 to 22 (Step S2) and judges whether the postal matter P is taken out normally or not. At this time, the controller 50, when any of the sensors does not become dark even if a specified period of time elapses after start of take-out (NO at Step S2, YES at Step S3), judges that there are possibilities that the postal matter P may be stuck to the suction chamber 35 and stay there. By this judgment, the controller 50 turns off the suction valve 51 (Step S4) and simultaneously switches the switching valve 57 to the side of the aiding roller 42 (Step S5).

On the other hand, at Step S2, if the controller 60 judges that any of the sensors 17 to 22 becomes dark within the specified period of time and the postal matter P is taken out normally onto the conveying route 9 (YES at Step S2), the controller 50 checks the output of the residual sensor 71, under the condition that there is the postal matter P to be processed in the supplying structure 11 (YES at Step S6), returns to the process at Step S1, and continues the take-out operation for the postal matter P. Further, the controller 50, when judging at Step S6 that there is no postal matter P in the supplying structure 11 (NO at Step S6), finishes the operation.

As explained at Step S4, if the suction valve 51 is turned off when the postal matter P is stuck to the suction chamber 35, the suction force to the postal matter P by the suction structure 13 does not act and the restriction force to the postal matter P by the suction structure 13 is canceled. In this state, the taking-out belt 32 moving in the direction of the arrow T is in contact with the postal matter P, so that the take-out of the postal matter P is restarted by the frictional force between the postal matter P and the taking-out belt 32. Further, at this time, when the switching valve 57 is switched as at Step S5 and negative pressure is generated on the peripheral surface of the aiding roller 42, if the aiding roller 42 is rotated in the direction of the arrow T, the trailing edge of the postal matter P in the take-out direction is pressed in the take-out direction, and the take-out operation for the postal matter P is aided.

Further, at this time, if the switching valve 57 is switched to the side of the aiding roller 42, the negative pressure generated on the peripheral surface of the separation roller 37 is eliminated, though at the point of time when the switching valve 57 is switched at Step S5, there is not the postal matter P to be separated on the conveying route 9, so that there is no need to function the separation structure 14, thus there is no problem.

At Step S5, the vacuum pump 46 is connected to the side of the aiding roller 42, and then the controller 50 judges whether the postal matter P is conveyed normally via the six sensors 17 to 22 or not (Step S7), and under the condition that any of the sensors 17 to 22 becomes dark within the specified period of time (YES at Steps S8 and S7), opens the suction valve 51 to suck the next postal matter P (Step 9), switches the switching valve 57 to the side of the separation roller 37 (Step S10), returns to Step S1, and starts taking-out of the next postal matter P. On the other hand, as a result of the judgment at Step S8, when any of the sensors 17 to 22 does not become dark even if the specified period of time elapses (NO at Step S7, YES at Step S8), the controller 50 stops the sheet take-out apparatus 1 and removes the postal matter P by an operator's hand operation.

As mentioned above, according to this embodiment, the similar effects as those of the first and second embodiments aforementioned can be obtained and additionally, the switching valve 57 is installed, thus the vacuum pump 41 of the separation structure 14 can be eliminated, and in correspondence to it, the apparatus constitution can be simplified, and the manufacturing cost of the apparatus can be reduced.

The sheet take-out apparatus of the present invention has the aforementioned constitution and operation, so that sheets can be taken out stably without reducing the processing capacity.

Further, the present invention is not limited to the aforementioned embodiments themselves and at the execution stage, within a range which is not deviated from the object of the present invention, the components can be modified and reduced into practice. Further, by appropriate combinations of the plurality of components disclosed in the embodiments, various inventions can be formed. For example, some components may be deleted from all the components indicated in the embodiments aforementioned. Furthermore, components extending over different embodiments may be combined appropriately.

For example, in the embodiments aforementioned, when the postal matter P cannot be taken out, the suction structure 13 is controlled so as to turn off the suction valve 51 and stop the air flow, though the present invention is not limited to it and for example, a shutter for closing the plurality of holes of the guide 24 is installed, and some of the holes are closed, thus so as to at least reduce the air current, the operation of the suction structure 13 may be controlled.

What is claimed is:

1. A sheet take-out apparatus comprising:

a supplying structure configured to move a plurality of sheets supplied in a stacking state in a stacking direction and supply a sheet at a leading edge thereof in a movement direction to a take-out position;

a take-out structure including a vacuum chamber and a first air pressure source, configured to make contact with the sheet and generate an air current to suck the sheet supplied to the take-out position and rotate a front surface of the vacuum chamber, thereby taking out the sheet in a direction almost orthogonal to the stacking direction, and move the sheet to a conveying route;

a suction structure including a suction chamber and a second air pressure source, the suction chamber being provided separately from the take-out structure, configured to generate an air current by the second air pressure source suctioning an air of the suction chamber to suck the sheet at the leading edge in the movement direction to the take-out position on an upstream side of a position where the take-out structure makes contact with the sheet in the sheet take-out direction by the take-out structure;

an aiding structure configured to make contact with the sheet at the leading edge in the movement direction on the upstream side in the take-out direction of the position where the suction structure is provided and rotating, thereby aiding a sheet take-out operation and applying the brake onto a trailing edge of a succeeding sheet after a preceding sheet is taken out;

a sensor to detect passing of the sheet taken out from the take-out position onto the conveying route; and a controller configured to judge that the sheet at the leading edge in the movement direction is not taken out by the take-out structure when the sensor detects non-passing of the sheet within a specified period of time, to control the operation of the suction structure so as to at least weaken the suction force by the suction structure when and to make operation of the aiding structure to aid the sheet take-out operation by making contact with the sheet and rotating in a sheet-take out direction.

2. The apparatus according to claim 1, wherein the controller controls the operation of the suction structure so as to stop the air current and makes the operation of the aiding structure to send the sheet to the take-out direction when the controller judges the sheet at the leading edge in the movement direction is not taken out by the take-out structure.

3. A sheet take-out apparatus comprising:

a supplying structure configured to move a plurality of sheets supplied in a stacking state in a stacking direction and supply a sheet at a leading edge thereof in a movement direction to a take-out position;

a take-out structure configured to make contact with the sheet supplied to the take-out position and rotate, thereby taking out the sheet in a direction almost orthogonal to the stacking direction, and move the sheet to a conveying route;

a suction structure configured to generate an air current to suck the sheet at the leading edge in the movement direction to the take-out position on an upstream side of a position where the take-out structure makes contact with the sheet in the sheet take-out direction by the take-out structure;

an aiding structure configured to make contact with the sheet at the leading edge in the movement direction on the upstream side in the take-out direction of the position where the take-out structure makes contact with the sheet and rotating while the sheet at the leading edge receives a negative pressure, thereby sending a sheet to the take-out direction;

a separation structure arranged on the opposite side of the take-out structure across a conveying route extended from the take-out position to act negative pressure on the sheet taken out on the conveying route, simultaneously giving separation force in the opposite direction of the take-out direction to the sheet, and separate second and subsequent sheets taken out by the sheet taken out from the take-out position;

a convertible air pressure source configured to generate the negative pressure of the aiding structure and separation structure; and a valve configured to selectively switch the negative pressure by the air pressure source to either of the aiding structure and separation structure, a controller configured to control the operation of the suction structure so as to decrease the suction force by the suction structure and control so as to switch the valve so as to generate the negative pressure in the aiding structure when the sheet at the leading edge in the movement direction is not taken out by the take-out structure.

4. The apparatus according to claim 3, wherein the controller controls to switch the valve so as to generate the negative pressure in the separation structure when the sheet at the leading edge in the movement direction is taken out normally by the take-out structure.

* * * * *